US006305666B1

(12) United States Patent
Sakai

(10) Patent No.: US 6,305,666 B1
(45) Date of Patent: Oct. 23, 2001

(54) VALVE SEAT MADE OF FE-BASED SINTERED ALLOY EXCELLENT IN WEAR RESISTANCE

(75) Inventor: Masaaki Sakai, Niigata (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/569,881

(22) Filed: May 12, 2000

Related U.S. Application Data

(63) Continuation-in-part of application No. 09/341,136, filed as application No. PCT/JP98/05095 on Nov. 12, 1998.

(30) Foreign Application Priority Data

Nov. 14, 1997 (JP) ..... 9-313378

(51) Int. Cl.[7] ..... C22C 33/02; C22C 38/42; F16K 51/00

(52) U.S. Cl. ..... 251/368; 75/246

(58) Field of Search ..... 251/308; 75/246, 75/247

(56) References Cited

U.S. PATENT DOCUMENTS 4,204,031 * 5/1980 Takemura et al. ..... 428/539.5
4,233,073 * 11/1980 Takemura ..... 75/243
4,546,737 * 10/1985 Kazouka et al. ..... 251/368 X
4,671,491 * 6/1987 Kuroishi et al. ..... 251/368
4,734,968 * 4/1988 Kuroishi et al. ..... 29/156.7 A
4,915,735 * 4/1990 Motooka ..... 75/231
5,031,878 * 7/1991 Ishikawa et al. ..... 251/368

FOREIGN PATENT DOCUMENTS 3-225008 * 10/1991 (JP) ..... 251/368

* cited by examiner

*Primary Examiner*—Kevin Shaver
*Assistant Examiner*—Eric Keasel
(74) *Attorney, Agent, or Firm*—Oblon, Spivak, McClelland, Maier & Neustadt, P.C.

(57) ABSTRACT

A valve seat made of Fe-based sintered alloy, the Fe-based sintered alloy comprising, on a weight percent basis:

| | | | |
|---|---|---|---|
| C: | 0.5–2%, | Si: | 0.05–1% |
| Co: | 8–16%, | Cr: | 2–8% |
| Mo: | 1.5–6%, | W: | 1.5–6% |
| Ni: | 0.5–2%, | Nb: | 0.05–1%, and |

calcium fluoride: 1–15%, with the balance Fe and the inevitable impurities, wherein the Fe-based sintered alloy has a structure in which Co-based alloy hard particles A, which comprise Co—Mo—Cr alloy and have high temperature wear resistance, and Cr-based alloy hard particles B, which comprise Cr—W—Co—Fe alloy and have ordinary temperature wear resistance, are dispersed and distributed in the alloy steel base in a total amount of 6–26 area percent when they are observed on a structural photograph recorded by an optical microscope, wherein, in the alloy, the ratio of hard particles A to total hard particles is 25–75 area percent, and wherein the calcium fluoride particles are dispersed and distributed in the alloy steel base in an amount of 3–45 area percent, and the Fe-based sintered alloy has a porosity of 5–25%, said valve seat having excellent in wear resistance.

8 Claims, No Drawings

VALVE SEAT MADE OF FE-BASED SINTERED ALLOY EXCELLENT IN WEAR RESISTANCE

CROSS-REFERENCE TO RELATED APPLICATIONS

The present application is a continuation-in-part of copending U.S. Application Ser. No. 09/341,136 filed Jul. 14, 1999 which is a 371 of PCT/JP98/05095 filed Nov. 12, 1998.

BACKGROUND OF THE INVENTION

1. Field of the Invention

The present invention relates to a valve seat made of Fe-based sintered alloy, as a structural member for internal combustion engines such as diesel engines, gasoline engines and the like.

2. Description of the Background

As disclosed in, for example, Japanese Unexamined Patent Publication No. 55-164063, Japanese Unexamined Patent Publication No. 58-178073 and the like, many valve seats have been proposed which are made of hard-particle dispersing type Fe-based sintered alloys as valve seats for internal combustion engines made of Fe-based sintered alloy. Recently, however, not only the production of internal combustion engines has greatly increased, but also the size of the engines has increased, which means that the valve seats, which are a structural member of the internal combustion engines, are compelled to operate in the environment of higher temperatures. However, when the conventional Fe-based sintered alloy valve seats and many other valve seats are used in the higher temperature environment of these engines, they are abruptly worn and their effective lives end in a relatively short period of time. A need continues to exist for valve seats of improved wear resistance, when exposed to higher temperature engine operating conditions.

SUMMARY OF THE INVENTION

Accordingly, one object of the present invention is to provide valve seats for internal combustion engines which exhibit excellent wear resistance, even when exposed to high temperature engine operating environments.

Briefly, this object and other objects of the present invention as hereinafter will become more readily apparent can be attained by valve seats for the internal combustion engine which are an Fe-based sintered alloy comprising, on a weight percent basis:

| | | | |
|---|---|---|---|
| C: | 0.5–2%, | Si: | 0.05–1% |
| Co: | 8–16%, | Cr: | 2–8%, |
| Mo: | 1.5–6%, | W: | 1.5–6%, |
| Ni: | 0.5–2%, | Nb: | 0.05–1%, and |

calcium fluoride: 1–15%, with the balance Fe and the inevitable impurities, wherein the Fe-based sintered alloy of the invention, having the above-described composition, has a structure in which Co-based alloy hard particles A, which comprise Co—Mo—Cr alloy and have high temperature wear resistance, and Cr-based alloy hard particles B, which comprise Cr—W—Co—Fe alloy and have ordinary temperature wear resistance, are dispersed and distributed in an alloy steel base in a total amount of 6–26 area percent when they are observed on a structural photograph recorded by an optical microscope. In the alloy, the ratio of hard particles A to total hard particles is 25–75 area percent. Further, calcium fluoride particles are dispersed and distributed in the alloy steel base at a ratio of 3–45 area percent, and the Fe-based sintered alloy has a porosity of 5–25%.

DETAILED DESCRIPTION OF THE PREFERRED EMBODIMENTS

The Fe-based sintered alloy of the invention, having the above-described composition, is such that the valve seat made of the Fe-based sintered alloy, containing the hard particles A, possess particularly excellent high temperature wear resistance, excellent wear resistance of the valve seat can be achieved, even when the valve seat is used under high temperature conditions. In addition, excellent ordinary temperature wear resistance of the valve seat can be secured by the hard particles B, and the wear resistance can be further improved by the lubricating property improving effect achieved by the $CaF_2$ particles. Further, the wear resistance, particularly at the moment of initial operation of an internal combustion engine and when the internal combustion engine is operated at low speeds can be improved as a result of the cooperating lubricating improving effect and the ordinary temperature wear resistance improving effect of the present alloy. As a result, the valve seat exhibits excellent wear resistance as a whole for a long time.

In another aspect of the invention, the thermal conductivity and the strength of the Fe-based sintered alloy can be improved by infiltrating the sintered alloy with copper or copper alloy, while the lubricating property, the vibration restricting property and the cut-ability property of the Fe-based sintered alloy can be improved by infiltrating the sintered alloy with lead or lead alloy. The additions of Cu or Cu alloy or Pb or Pb alloy can be made as desired.

The valve seat of the present invention employs a steel alloy powder as a base forming alloy powder. The alloy powder has the composition: 0.2–3% C, 0.5–7% Ni, 1–12% Co, 0.05– 1.5% Nb, and further includes, when necessary, one or more of the elements of 0.3–6% Cr, 0.2–6% Mo, 0.5–6% W and 0.1–1% Si, with the balance Fe and the inevitable impurities. The Co-based alloy powder which serves as the alloy forming powder for hard particles A comprises Co—Mo—Cr alloy containing 20–35% Mo, 5–10% Cr and 1–4% Si, with the balance Co and the inevitable impurities; and the Cr-based alloy powder which serves as the alloy forming powder for hard particles B comprises Cr—W—Co—Fe alloy containing 0.5–3% C, 15–30 W, 15–30% Co, 5–15% Fe, 0.2–2% Nb and 0.2–2% Si, with the balance of Cr and the inevitable impurities. These powder materials are blended with each other in prescribed relative amounts together with $CaF_2$ powder which is also prepared as a powder material. The powders are mixed under ordinary conditions and formed into prescribed shapes with a press and sintered. Further, the sintered alloy is infiltrated with copper or copper alloy, or lead or lead alloy, as desired. The valve seat of the present invention is made by the above processes.

As to the base forming powder material, element powders, or element powders and alloy powders may be used in place of the alloy steel powder by blending these powders in relative amounts so that they have the same composition as the composition of the alloy steel powder.

In the valve seat of the present invention, the reasons why the whole composition of the Fe-based sintered alloy constituting the valve seat, the ratio of the hard particles to the $CaF_2$ particles and further the porosity of the product are defined as described above are as follows:

(A) Composition (a) Carbon

The carbon component acts by strengthening the base metal by being dissolved in the base metal in a solid state. The wear resistance of the base metal is improved by forming a carbide which is dispersed in the base metal and the wear resistance of the hard particles A and B is also improved by containing such carbides. A C content in an amount of not larger than 0.5% does not result in the desired improvement in strengthening, while a C content exceeding 2% results in an abrupt increase in the counterpart attracting property. Therefore, the C content is defined as 0.5–2%, preferably 0.8–1.5%.

(b) Si

The Si component has the action of forming hard intermetallic compounds by being mainly present in the hard particles A and B and contributes by improving the wear resistance of the particles. However, the Si content of the particles in an amount not larger than 0.05% does not result in the desired improving effect, whereas a Si content exceeding 1% results in embrittlement of the hard particles B with deterioration of the wear resistance. Therefore, the Si content of the alloy is defined as 0.05–1%, preferably 0.2–0.7%.

(c) Co

The Co component has the action of strengthening the base metal by being dissolved in it in the solid state, as well as contributing to the improvement of the high temperature wear resistance of the hard particles A and for strengthening the hard particles B by being dissolved therein in the solid state. However, a Co content in an amount of not larger than 8% does not result in the desired effects, whereas a Co content exceeding 16% results in deterioration of the wear resistance of the valve seat itself. Therefore, the Co content is defined as 8–16%, preferably 10–14%.

(d) Cr

The Cr component has an action of strengthening the base metal by being dissolved therein in the solid state. This component results in improvement of the ordinary temperature wear resistance of hard particles B by forming carbide and intermetallic compounds therein by being present as the main component. The carbides and compounds further contribute to improvement of the high temperature wear resistance of the hard particles A by forming carbide and intermetallic compounds therein in the presence of the Co component. However, a Cr content in an amount of not larger than 2% does not result in the desired effect, whereas a Cr content exceeding 8% results in the deterioration of the sintering property and does not secure the desired strength of the valve seat. Therefore, the Cr content is defined as 2–8%, preferably 4–6%.

(e) Mo

The Mo component has the action of strengthening the base metal by being dissolved therein in the solid state, and improves the high temperature wear resistance of the hard particles A by being present therein without being substantially present in the hard particles B. The Mo component largely coexists with Co. However, a Mo content in an amount of not larger than 1.5% does not result in the desired effects, whereas a Mo content exceeding 6% results in an increase in the counterpart attracting property. Therefore, the Mo content is defined as 1.5–6%, preferably 2–4%.

(f) W

The W component has the action of contributing to improvement of the ordinary temperature wear resistance of the hard particles B by forming carbide and intermetallic compounds therein. However, a W content in an amount of not larger than 1.5% does not result in the desired effect, whereas, a W content exceeding 6% results in an increase in the counterpart attracting property. Therefore, the W content is defined as 1.5–6%, preferably 2–4%.

(g) Ni

The Ni component has the action of strengthening the hard particles A and B by being present in them. However, a Ni content in an amount of not larger than 0.5% does not result in the desired effect, whereas, a Ni content exceeding 2% results in deterioration of the wear resistance. Therefore, the Ni content is defined as 0.5–2%, preferably 0.8–1.5%.

(h) Nb

The Nb component has the action of contributing to the improvement of the ordinary temperature wear resistance of the hard particles B by forming carbides mainly within the particles. However, a Nb content in an amount of not larger than 0.05% does not result in the desired effect, whereas a Nb content exceeding 1% results in an increase in the counterpart attracting property. Therefore, the Nb content is defined as 0.05–1%, preferably 0.2–0.7%.

(i) $CaF_2$

The $CaF_2$ component has the action of improving the lubricating property and the wear resistance of the product, and in particular improves the initial wear resistance of the alloy product upon operation of the internal combustion engine and when the internal combustion engine is in operation at low speeds, as the component is present with the hard particles B. However, if the $CaF_2$ content is present in an amount not larger than 1%, the ratio of $CaF_2$ which is dispersed and distributed in the base metal would be not larger than 3 area percent and the desired effect could not be obtained. Whereas, if the $CaF_2$ content is in an amount exceeding 15%, the ratio of $CaF_2$ which is dispersed and distributed in the base metal would exceed 45 area percent which is excessively large with the result that product strength is diminished. Therefore, the $CaF_2$ content is defined as 1–15%, preferably 3–10%.

(B) Ratio of Hard Particles

As described above, the valve seat is provided with excellent high and ordinary temperature wear resistance by the respective hard particles A and B. Therefore, when the ratio of the hard particles A to the hard particles A and B is not larger than 25 area percent, the desired high temperature wear resistance could not be obtained. Whereas, when the ratio of the hard particles A exceeds 75 area percent, the desired ordinary temperature wear resistance can be secured as well as the wear resistance under the initial operational conditions of the internal combustion engine and when the internal combustion engine is in operation at low speeds can not be secured by the presence of the hard particles B with the $CaF_2$ particles. This is because the amount of the hard particles B is made relatively too small. Accordingly, the amount of the hard particles A is determined as 25–75 area percent, preferably 40–60 vol. %.

When the amount of the combined hard particles A and B is not larger than 6 area percent, the desired wear resistance could not be secured. Whereas, when the combined amount of the hard particles A and B exceeds 26 area percent, not only does the counterpart attacking property abruptly increase but also the strength is lowered. Thus, the combined amount is determined as 6–26 area percent, preferably 10–20 area percent.

C) Ratio of $CaF_2$

As described above, the $CaF_2$ particles improve the wear resistance of the alloy product by the improved lubrication effect, as well as improve the wear resistance of the alloy product under the initial operation of the internal combustion engine and when the internal combustion engine is in operation at low speeds, in cooperation with the ordinary temperature wear resistance improving effect of the hard particles B. If the amount of the $CaF_2$ particles is not larger than 3 area percent, the desired improving effect can not be achieved, whereas, if the ratio of the $CaF_2$ particles exceeds 45 area percent, the strength of the product will be diminished. Therefore, the amount of the $CaF_2$ particles is determined as 3–45 area percent, preferably 9–30 area percent.

(D) Porosity

If the porosity of the alloy product is not larger than 5%, the lubricating improving effect resulting from an oil maintaining effect can not be expected. In addition, copper and copper alloy, or lead and lead alloy will unevenly infiltrate the alloy product and the effect of infiltration can not be sufficiently exhibited. Whereas, if the porosity exceeds 25%, reduction of strength and wear resistance can not be avoided. Therefore, the porosity is determined as 5–25%, preferably 10–20%.

In an especially preferred embodiment of the invention, the valve seat is prepared as follows:

First, base metal forming alloy powders M-1 to M-13, hard particles A forming alloy powders A-1 to A-6, and hard particles B forming alloy powders B-1 to B-13, each having the average particle size and the composition shown in Table 1 to Table 3 were prepared. The particles were blended with each other according to the combination shown in Table 4, and then further blended with $CaF_2$ powder in a prescribed amount, which was prepared similarly as a powder material and had a particle size of −200 mesh. Zinc stearate was added to the resultant powder in the amount of 1% and the combined material was mixed in a mixer for 30 minutes. The resulting powder material was pressed to a green compact at a prescribed pressure within the range of 5–7 ton/cm$^2$. The green compact was held at 500° C. for 30 minutes and degreased. The green compact was then sintered under the conditions of a prescribed temperature within the range of 1180–1250° C. for one hour under an atmosphere of a decomposed ammonia gas. By this process, the valve seats 1–13 of the present invention and comparative valve seats 1–4 were mad. Each of the valve seats was composed of a Fe-based sintered alloy which had the entire composition, the ratios of the hard particles and the $CaF_2$ particles (measured with an image analyzing apparatus based on structural photographs recorded by a×100 optical microscope) and the porosity shown in Tables 5–8, respectively. Further, each of the valve seats had the dimension of an outside diameter of 34 mm×a minimum inside diameter of 27 mm×a thickness: 7.2 mm.

The amounts of the hard particles and further the amounts of the $CaF_2$ particles in the comparative valve seats 1–4 fall outside the ranges of the present invention, and thus the entire compositions of the comparative examples fall outside the range of the composition of the present invention.

Further, the copper-infiltrated valve seats 1–13 of the present invention and comparative copper-infiltrated valve seats 1–4 were made in the following manner. That is, the valve seats 1–13 of the present invention and the comparative valve seats 1–4 were used as main bodies. Then the valve bodies were infiltrated with a material composed of pure copper, Cu-3% Co alloy (hereinafter, referred to as Cu alloy 1), Cu-3% Fe-2% Mn-2% Zn alloy (hereinafter, referred to as Cu alloy 2), or Cu-30% Zn alloy (hereinafter, referred to as Cu alloy 3). A copper material was placed on each of the main bodies in the combinations shown in Table 9; and the main bodies were subjected to copper or copper alloy infiltration processing under the conditions stated above and were held at 1100° C. for 15 minutes under an atmosphere of a methane denatured gas.

In the same way, the lead-infiltrated valve seats 1–13 of the present invention and comparative lead-infiltrated valve seats 1–4 were made. That is, the valve seats 1–13 of the present invention and the comparative valve seats 1–4 were used as main bodies; and an infiltrating material composed of pure lead, Pb-4% Sb alloy (hereinafter, referred to as alloy a), or Pb-5% Sn alloy (hereinafter, referred to as alloy b), was placed on each of the main bodies in the combinations shown in Table 10. The main bodies were subjected to lead or lead alloy infiltration processing under the conditions that they were dipped into a bath in which the infiltrating material was heated in a nitrogen atmosphere with a pressure of 8 kg/cm$^2$ applied to the surface of the heated infiltrating material.

Wear tests were conducted on the various types of the resultant valve seats using a table type valve seat wear tester under the following conditions, and the maximum worn depth of the valve sheets and the maximum worn depth of a valve as a counterpart were measured.

Valve material: SUH-3

Valve heating temperature: 800° C.

Number of valve seating: 3000 times/min

Atmosphere: combustion gas composed of propane gas having a pressure of 0.4 kg/cm$^2$ and an oxygen gas having a flow rate of 1.5 1/min Valve seat heating temperature (water cooled): 300–400° C.

Seating load: 30 kg

Test time: 20 cycles each including a continuous operation of one hour and an interruption of 10 minutes Tables 7–10 show the results of the measurements.

TABLE 1

| Type | Average Particle Size (μm) | Composition (wt. %) C | Co | Ni | Nb | Cr | Mo | W | Si | Fe + impurities |
|---|---|---|---|---|---|---|---|---|---|---|
| | | Base Metal Forming Alloy Powder | | | | | | | | |
| M-1 | 85 | 0.52 | 10.5 | 1.0 | 0.48 | 1.6 | 3.3 | 2.3 | 0.45 | Residues |
| M-2 | 101 | 1.25 | 6.8 | 1.2 | 0.65 | 2.0 | 1.2 | 2.1 | 0.18 | Residues |
| M-3 | 70 | 2.10 | 9.6 | 1.5 | 0.62 | 4.0 | 2.0 | 3.2 | 0.24 | Residues |
| M-4 | 94 | 0.93 | 10.4 | 4.0 | 0.53 | 3.5 | 3.1 | 4.1 | — | Residues |
| M-5 | 101 | 0.76 | 4.8 | 1.3 | 0.68 | 1.1 | 3.5 | 2.0 | 0.93 | Residues |
| M-6 | 90 | 0.83 | 3.6 | 1.2 | 0.88 | 3.4 | 2.0 | 4.8 | 0.42 | Residues |
| M-7 | 73 | 0.65 | 4.9 | 1.4 | 0.88 | 1.6 | 2.4 | 2.0 | 0.25 | Residues |

TABLE 1-continued

| Type | Average Particle Size (μm) | Composition (wt. %) C | Co | Ni | Nb | Cr | Mo | W | Si | Fe + impurities |
|---|---|---|---|---|---|---|---|---|---|---|
| M-8 | 86 | 1.35 | 9.4 | 1.8 | 0.10 | — | 1.3 | 4.6 | 0.61 | Residues |
| M-9 | 91 | 1.00 | 1.2 | 2.1 | 0.17 | 2.5 | — | 1.5 | — | Residues |
| M-10 | 110 | 0.94 | 8.0 | 1.9 | 0.55 | 3.4 | 0.2 | 1.2 | 0.36 | Residues |
| M-11 | 75 | 1.05 | 6.2 | 1.0 | 0.46 | 0.3 | 3.0 | 2.3 | 0.27 | Residues |
| M-12 | 89 | 1.02 | 7.0 | 1.2 | 0.51 | 2.0 | 1.5 | — | 0.54 | Residues |
| M-13 | 93 | 0.50 | 2.1 | 2.4 | 0.42 | 2.1 | 2.1 | 4.2 | 0.30 | Residues |

TABLE 2

| Type | Average Particle Size (μm) | Composition (wt. %) Mo | Cr | Si | Co + Impurities |
|---|---|---|---|---|---|
| | Hard Particles A Forming Alloy Powder | | | | |
| A-1 | 76 | 20.5 | 8.4 | 2.3 | Residues |
| A-2 | 92 | 34.7 | 8.1 | 2.6 | Residues |
| A-3 | 65 | 28.3 | 7.6 | 3.5 | Residues |
| A-4 | 74 | 28.4 | 6.3 | 1.3 | Residues |
| A-5 | 81 | 27.6 | 5.2 | 2.2 | Residues |
| A-6 | 100 | 30.5 | 9.7 | 2.3 | Residues |

TABLE 3

| Type | Average Particle Size (μm) | Composition (wt. %) C | W | Co | Fe | Nb | Si | Cr + impurities |
|---|---|---|---|---|---|---|---|---|
| | | Hard Particle B Forming Alloy Powder | | | | | | |
| B-1 | 112 | 0.52 | 28.3 | 23.2 | 7.8 | 0.85 | 1.12 | Residues |
| B-2 | 76 | 1.79 | 22.0 | 28.4 | 10.0 | 1.14 | 1.65 | Residues |
| B-3 | 80 | 2.93 | 20.1 | 28.6 | 12.2 | 1.46 | 1.23 | Residues |
| B-4 | 103 | 2.15 | 15.5 | 26.6 | 14.6 | 1.72 | 0.84 | Residues |
| B-5 | 68 | 2.16 | 29.3 | 19.7 | 8.4 | 1.66 | 0.56 | Residues |
| B-6 | 75 | 2.21 | 25.0 | 15.3 | 8.7 | 1.73 | 1.05 | Residues |
| B-7 | 62 | 1.89 | 27.2 | 29.6 | 8.8 | 1.14 | 1.73 | Residues |
| B-8 | 108 | 1.83 | 19.1 | 29.4 | 5.2 | 0.94 | 1.64 | Residues |
| B-9 | 71 | 1.15 | 22.3 | 19.1 | 14.6 | 1.26 | 1.61 | Residues |
| B-10 | 100 | 1.24 | 28.1 | 22.3 | 7.4 | 0.22 | 1.22 | Residues |
| B-11 | 74 | 2.33 | 29.0 | 20.2 | 7.2 | 1.97 | 1.23 | Residues |
| B-12 | 73 | 2.52 | 26.4 | 21.1 | 6.8 | 1.78 | 0.24 | Residues |
| B-13 | 62 | 2.21 | 26.5 | 28.6 | 11.1 | 1.92 | 1.93 | Residues |

TABLE 4

| Type | Combination: Base Metal Forming Alloy Powder | Hard Particles A Forming Alloy Powder | Hard Particles B Forming Alloy Powder |
|---|---|---|---|
| | | Valve Seat of the Invention | |
| 1 | M-1 | A-1 | B-1 |
| 2 | M-2 | A-2 | B-2 |
| 3 | M-3 | A-3 | B-3 |
| 4 | M-4 | A-4 | B-4 |
| 5 | M-5 | A-5 | B-5 |
| 6 | M-6 | A-6 | B-8 |
| 7 | M-7 | A-1 | B-9 |
| 8 | M-8 | A-2 | B-8 |
| 9 | M-9 | A-3 | B-9 |
| 10 | M-10 | A-5 | B-10 |

TABLE 4-continued

| Type | Combination | | |
|---|---|---|---|
| | Base Metal Forming Alloy Powder | Hard Particles A Forming Alloy Powder | Hard Particles B Forming Alloy Powder |
| 11 | M-11 | A-5 | B-11 |
| 12 | M-12 | A-6 | B-12 |
| 13 | M-13 | A-1 | B-13 |
| | | Comparative Valve Set | |
| 1 | M-3 | A-1 | B-1 |
| 2 | M-6 | A-2 | B-2 |
| 3 | M-9 | A-3 | B-3 |
| 4 | M-12 | A-4 | B-4 |

TABLE 5

| Type | Whole Composition (wt. %) | | | | | | | | | |
|---|---|---|---|---|---|---|---|---|---|---|
| | C | Si | Co | Cr | Mo | W | Ni | Nb | $CaF_2$ | Fe + impurities |
| | | | | | Valve Seat of the Invention | | | | | |
| 1 | 0.54 | 0.52 | 11.9 | 3.3 | 3.5 | 3.6 | 1.4 | 0.54 | 1.2 | Residues |
| 2 | 1.20 | 0.49 | 12.1 | 5.4 | 3.4 | 3.5 | 1.0 | 0.65 | 5.2 | Residues |
| 3 | 1.97 | 0.53 | 14.5 | 4.7 | 3.8 | 3.6 | 1.2 | 0.62 | 8.6 | Residues |
| 4 | 0.95 | 0.052 | 11.6 | 5.1 | 4.3 | 4.1 | 1.3 | 0.53 | 13.2 | Residues |
| 5 | 0.90 | 1.02 | 10.2 | 6.0 | 4.7 | 5.7 | 1.0 | 0.71 | 7.5 | Residues |
| 6 | 0.81 | 0.60 | 8.3 | 5.7 | 4.2 | 5.2 | 1.3 | 0.83 | 8.81 | Residues |
| 7 | 0.70 | 0.72 | 15.7 | 5.9 | 4.6 | 5.5 | 1.1 | 0.81 | 11.2 | Residues |
| 8 | 1.31 | 0.81 | 12.6 | 2.3 | 3.4 | 4.7 | 1.5 | 0.22 | 14.7 | Resdiues |
| 9 | 0.85 | 0.65 | 11.6 | 7.8 | 3.3 | 4.3 | 1.6 | 0.31 | 10.2 | Residues |

TABLE 6

| Type | Whole Composition (wt. %) | | | | | | | | | |
|---|---|---|---|---|---|---|---|---|---|---|
| | C | Si | Co | Cr | Mo | W | Ni | Nb | $CaF_2$ | Fe + Impurities |
| | | | | | Valve Seat of the Invention | | | | | |
| 10 | 0.90 | 0.53 | 12.4 | 7.6 | 1.51 | 4.0 | 1.3 | 0.52 | 9.2 | Residues |
| 11 | 0.96 | 0.58 | 14.5 | 3.1 | 6.0 | 3.6 | 0.8 | 0.49 | 13.7 | Residues |
| 12 | 1.01 | 0.72 | 11.7 | 5.2 | 3.9 | 1.52 | 0.9 | 0.50 | 4.2 | Residues |
| 13 | 0.61 | 0.63 | 12.1 | 4.5 | 3.9 | 5.7 | 1.9 | 0.52 | 2.1 | Residues |
| | | | | | Compensation Valve Seat | | | | | |
| 1 | 2.14* | 0.26 | 11.2 | 4.5 | 2.2 | 3.6 | 1.1 | 0.61 | 10.6 | Residues |
| 2 | 0.62 | 0.71 | 10.5 | 4.2 | 6.2* | 3.8 | 1.0 | 0.56 | 6.8 | Residues |
| 3 | 0.93 | 0.33 | 6.8* | 3.5 | 2.2 | 1.8 | 1.6 | 0.21 | 17.2 | Residues |
| 4 | 0.91 | 0.52 | 0.0 | 2.6 | 2.0 | 0.3* | 0.9 | 0.43 | 0.8* | Residues |

Indicates component outside the scope of the invention

TABLE 7

| Type | Relative Ratio (area %) | | Hard Particles (area %) | Maximum Worn $CaF_2$ Particles (area %) | Porosity | Depth of Valve Depth (μm) | Maximum Worn (μm) |
|---|---|---|---|---|---|---|---|
| | A | B | | | | | |
| | | | | Valve Seat of the Invention | | | |
| 1 | 25 | 75 | 6.1 | 3.1 | 23.8 | 101 | 9 |
| 2 | 51 | 49 | 14.5 | 15.1 | 19.7 | 41 | 10 |
| 3 | 73 | 27 | 10.2 | 25.7 | 17.9 | 56 | 19 |
| 4 | 27 | 73 | 6.4 | 39.0 | 5.2 | 54 | 4 |
| 5 | 31 | 69 | 17.5 | 22.6 | 16.0 | 16 | 8 |
| 6 | 60 | 40 | 12.2 | 26.7 | 9.7 | 45 | 11 |

TABLE 7-continued

| Type | Relative Ratio (area %) A | B | Hard Particles (area %) | Maximum Worn $CaF_2$ Particles (area %) | Porosity | Depth of Valve Depth (μm) | Maximum Worn (μm) |
|---|---|---|---|---|---|---|---|
| 7 | 49 | 51 | 24.2 | 33.3 | 9.0 | 15 | 17 |
| 8 | 64 | 36 | 9.7 | 44.5 | 21.0 | 64 | 9 |
| 9 | 52 | 46 | 25.5 | 30.3 | 21.3 | 26 | 30 |

TABLE 8

| Type | Hard Particles (area %) A | B | Relative Ratio (area) | $CaF_2$ Particles (area %) | Porosity | Maximum Worn Depth (μm) | Maximum Worn Depth of Valve (μm) |
|---|---|---|---|---|---|---|---|
| | | | | Valve Seat of the Invention | | | |
| 10 | 30 | 70 | 15.2 | 27.3 | 22.3 | 57 | 11 |
| 11 | 66 | 34 | 17.1 | 42.3 | 21.2 | 16 | 11 |
| 12 | 61 | 39 | 15.4 | 12.3 | 18.4 | 22 | 14 |
| 13 | 52 | 48 | 17.5 | 6.1 | 14.6 | 12 | 30 |
| | | | | Comparative Seat Valve | | | |
| 1 | 49 | 51 | 3.2* | 31.7 | 7.0 | 345 | 210 |
| 2 | 45 | 55 | 28.6* | 21.5 | 24.3 | 279 | 125 |
| 3 | 83* | 17* | 9.0 | 51.0* | 18.9 | 215 | 145 |
| 4 | 16* | 84* | 20.1 | 2.5* | 16.8 | 250 | 112 |

TABLE 9

| Type | Symbol of Main Body | Copper or Copper Alloy Infiltrating Material | Maximum Worn Depth (μm) | Maximum Worn Depth of Valve (μm) |
|---|---|---|---|---|
| Copper Infiltrated Valve Seat of the Invention | Valve Seat of the Invention | | | |
| 1 | 1 | Pure Copper | 63 | 18 |
| 2 | 2 | Pure Copper | 36 | 15 |
| 3 | 3 | Pure Copper | 39 | 7 |
| 4 | 4 | Cu Alloy 1 | 42 | 15 |
| 5 | 5 | Cu Alloy 2 | 27 | 17 |
| 6 | 6 | Cu Alloy 2 | 26 | 9 |
| 7 | 7 | Cu Alloy 3 | 13 | 8 |
| 8 | 8 | Cu Alloy 1 | 46 | 11 |
| 9 | 9 | Cu Alloy 2 | 19 | 16 |
| 10 | 10 | Cu Alloy 3 | 31 | 19 |
| 11 | 11 | Cu Alloy 2 | 12 | 25 |
| 12 | 12 | Pure Copper | 15 | 8 |
| 13 | 13 | Pure Copper | 8 | 26 |
| Comparative Copper Infiltrated Valve Seat | Comparative Valve Seat | | | |
| 1 | 1 | Pure Copper | 210 | 142 |
| 2 | 2 | Cu Alloy 1 | 148 | 104 |
| 3 | 3 | Cu Alloy 2 | 183 | 115 |
| 4 | 4 | Cu Alloy 3 | 215 | 123 |

TABLE 10

| Type | Symbol of Main Body | Lead or Lead Alloy Infiltrating Material | Maximum Worn Depth (μm) | Maximum Worn Depth of a Valve (μm) |
|---|---|---|---|---|
| Lead Infiltrated Valve Seat of the Invention | Valve Seat of the Invention | | | |
| 1 | 1 | Pure Lead | 88 | 9 |
| 2 | 2 | Pure Lead | 60 | 8 |
| 3 | 3 | Pure Lead | 62 | 7 |
| 4 | 4 | Alloy A | 67 | 8 |
| 5 | 5 | Alloy A | 25 | 11 |
| 6 | 6 | Alloy B | 28 | 17 |
| 7 | 7 | Alloy A | 29 | 8 |
| 8 | 8 | Alloy B | 41 | 12 |
| 9 | 9 | Alloy B | 16 | 18 |
| 10 | 10 | Pure Lead | 15 | 6 |
| 11 | 11 | Pure Lead | 17 | 9 |
| 12 | 12 | Pure Lead | 24 | 7 |
| 13 | 13 | Pure Lead | 19 | 11 |
| Comparative Lead Infiltrated Valve Seat | Comparative Valve Seat | | | |
| 1 | 1 | Pure Lead | 326 | 145 |
| 2 | 2 | Pure Lead | 360 | 115 |
| 3 | 3 | Alloy A | 145 | 73 |
| 4 | 4 | Alloy B | 137 | 81 |

INDUSTRIAL APPLICABILITY

It is apparent from the results shown in Table 4–10 that any of the valve seats 1–13 of the present invention, the copper-infiltrated valve seats 1–13 of the present invention, and the lead-infiltrated valve seats 1–13 of the present invention exhibits excellent wear resistance with a low counterpart attacking property under high temperature operating conditions. On the other hand, when the amount of the hard particles of the Fe-based sintered alloy which constitutes the valve seats and further the amounts of the hard particles and $CaF_2$ fall outside the range of the present invention, as found in the comparative valve seats 1–4, the comparative copper-infiltrated comparative valve seats 1–4, and the comparative lead-infiltrated comparative valve seats 1–4, the wear resistance is diminished and the counterpart attacking property is increased.

As described above, in the valve seat of the present invention, the high temperature and ordinary temperature wear resistance is greatly improved, particularly by the hard particles A and B in the Fe-based sintered alloy, which constitutes the valve seat. Further, the wear resistance under initial operating conditions of the internal combustion engine and when the internal combustion engine is in operation at low speeds is improved by the hard particles B and the $CaF_2$ which are present in the Fe-based sintered alloy in a state of coexistence Accordingly, the valve seat of the present invention exhibits excellent wear resistance, not only when the internal combustion engine is operated at an ordinary temperature, but also when it is operated at high temperatures.

The disclosure of Japanese Application No. 98-05095 filed Nov. 12, 1998 is hereby incorporated by reference into the present application.

Obviously, numerous modifications and variations of the present invention are possible in light of the above teachings. It is, therefore, to be understood that within the scope of the appended claims, the invention may be practiced otherwise than as specifically described herein

What is claimed as new and is intended to be secured by Letters Patent is:

1. A valve seat made of Fe-based sintered alloy, the Fe-based sintered alloy comprising, on a weight percent basis:

| | | | |
|---|---|---|---|
| C: | 0.5–2%, | Si: | 0.05–1% |
| Co: | 8–16% | Cr: | 2–8% |
| Mo: | 1.5–6% | W: | 1.5–6% |
| Ni: | 0.5–2% | Nb: | 0.05–1%, and |

calcium fluoride: 1–15%, with the balance Fe and the inevitable impurities, wherein the Fe-based sintered alloy has a structure in which Co-based alloy hard particles A, which comprise Co—Mo—Cr alloy and have high temperature wear resistance, and Cr-based alloy hard particles B, which comprise Cr—W—Co—Fe alloy and have ordinary temperature wear resistance, are dispersed and distributed in the alloy steel base in a total amount of 6–26 area percent when they are observed on a structural photograph recorded by an optical microscope, wherein, in the alloy, the ratio of hard particles A to total hard particles is 25–75 area percent, and wherein the calcium fluoride particles are dispersed and distributed in the alloy steel base in an amount of 3–45 area percent, and the Fe-based sintered alloy has a porosity of 5–25%, said valve seat having excellent wear resistance.

2. The valve seat of claim 1, wherein the hard particles A and B are dispersed in the alloy in an amount ranging from 10–20 area %.

3. The valve seat of claim 1, wherein the hard particles A of Co—Mo—Cr alloy comprise 20–35 wt. % Mo, 5–10 wt % Cr and 1–4 wt. % Si, with the balance Co and impurities.

4. The valve seat of claim 1, wherein the hard particles B of Cr—W—Co—Fe alloy comprise 0.5–3 wt. % C, 15–30 wt. % W, 15–30 wt. % Co, 5–15 wt. % Fe, 0.2–2 wt. % Nb and 0.2–2 wt. % Si, with the balance Cr and impurities.

5. The valve seat of claim 1, wherein the Fe-based sintered alloy comprises 0.8–1.5 wt. % C, 0.2–0.7 wt. % Si, 10–14 wt. % Co, 4–6 wt. % Cr, 2–4 wt. % Mo, 2–4 wt. % W, 0.8–1.5 wt. % Ni, 0.2–0.7 wt. % Nb and 3–10 wt. % $CaF_2$.

6. The valve seat of claim 1, wherein the Fe-based sintered alloy has a porosity of 10–20%.

7. A valve seat excellent in wear resistance made of Fe-based sintered alloy, the Fe-based sintered alloy comprising, as a whole composition, by weight

| | | | |
|---|---|---|---|
| C: | 0.5–2%, | Si: | 0.05–1% |
| Co: | 8–16%, | Cr: | 2–8%, |
| Mo: | 1.5–6%, | W: | 1.5–6%, |
| Ni: | 0.5–2%, | Nb: | 0.05–1%, and |

calcium fluoride: 1–15%, with the balance Fe and the inevitable impurities, wherein the Fe-based sintered alloy has a structure in which Co-based alloy hard particles A, which comprise Co—Mo—Cr alloy and have high temperature wear resistance, and Cr-based alloy hard particles B, which comprise Cr—W—Co—Fe alloy and have ordinary temperature wear resistance, are dispersed and distributed in an alloy steel base in a total amount of 6–26 area percent when they are observed on a structure photograph recorded by an optical microscope, and wherein the amount of the hard particles A to total hard particles is 25–75 area percent and wherein the calcium fluoride particles are dispersed and distributed in the alloy steel base in an amount of 3–45 area percent, and the Fe-based sintered alloy has a porosity of 5–25%, and wherein the Fe-based sintered alloy is infiltrated with copper or copper alloy, or lead or lead alloy.

8. A valve seat made of Fe-based sintered alloy, the Fe-based sintered alloy comprising, on a weight percent basis:

| | | | |
|---|---|---|---|
| C: | 0.5–2%, | Si: | 0.05–1% |
| Co: | 8–16% | Cr: | 2–8% |
| Mo: | 1.5–6% | W: | 1.5–6% |
| Ni: | 0.5–2% | Nb: | 0.05–1%, and |

calcium fluoride: 1–15%, with the balance Fe and the inevitable impurities, wherein the Fe-based sintered alloy has a structure in which Co-based alloy hard particles A, which comprise Co—Mo—Cr alloy having the composition of 20–35 wt. % Mo, 5–10 wt. % Cr and 1–4 wt. % Si, with the balance Co and impurities and have high temperature wear resistance, and Cr-based alloy hard particles B which comprise Cr—W—Co—Fe alloy having the composition of 0.5–3 wt. % C, 15–30 wt. % W, 15–30 wt. % Co, 5–15 wt. % Fe, 0.2–2 wt. % Nb and 0.2–2 wt. % Si, with the balance Cr and impurities and have ordinary temperature wear resistance, are dispersed and distributed in the alloy steel base in a total amount of 6–26 area percent when they are observed on a structural photograph recorded by an optical microscope, wherein, in the alloy, the ratio of hard particles A to total hard particles is 25–75 area percent, and wherein the calcium fluoride particles are dispersed and distributed in the alloy steel base in an amount of 3–45 area percent, and the Fe-based sintered alloy has a porosity of 5–25%, said valve seat having excellent wear resistance.

* * * * *